United States Patent [19]

Aiba et al.

[11] Patent Number: 4,601,595

[45] Date of Patent: Jul. 22, 1986

[54] PAPER SHEET SETTING MECHANISM IN A PRINTER

[75] Inventors: Masahiko Aiba, Nara; Koichi Furukawa, Kashihara, both of Japan

[73] Assignee: Sharp Kabushiki Kaisha, Osaka, Japan

[21] Appl. No.: 710,272

[22] Filed: Mar. 11, 1985

[30] Foreign Application Priority Data

Mar. 12, 1984 [JP] Japan ..... 59-47332

[51] Int. Cl.[4] ..... B41J 13/16; B41J 13/20; B41J 13/036

[52] U.S. Cl. ..... 400/637; 400/342; 400/705.1

[58] Field of Search ..... 400/342, 340, 351, 705, 400/705.1, 708, 708.1, 637-637.5

[56] References Cited

U.S. PATENT DOCUMENTS

| | | | |
|---|---|---|---|
| 3,785,471 | 1/1974 | Dodds | 400/349 |
| 4,272,204 | 6/1981 | Quinn, Jr. et al. | 400/342 |
| 4,303,346 | 12/1981 | Basse et al. | 400/342 |
| 4,408,917 | 10/1983 | Iwai et al. | 400/637.2 |
| 4,426,170 | 1/1984 | Bnda | 400/637 |

FOREIGN PATENT DOCUMENTS

| | | | |
|---|---|---|---|
| 39761 | 1/1929 | Denmark | 400/351 |
| 2937488 | 4/1981 | Fed. Rep. of Germany | 400/342 |
| 37357 | 3/1980 | Japan | 400/705.1 |
| 136368 | 10/1981 | Japan | 101/232 |

OTHER PUBLICATIONS

Wipke "Right Hand Margin . . . " IBM Technical Disclosure Bulletin, vol. 20, No. 10, pp. 3996-3997, 3/78.

*Primary Examiner*—William Pieprz

*Attorney, Agent, or Firm*—Birch, Stewart, Kolasch & Birch

[57] ABSTRACT

A paper sheet setting mechanism in a printer such as an ink jet system printer includes a memory device which stores a desired left setting position at which a left paper pressing roller should be positioned, and a desired right setting position at which a right paper pressing roller should be positioned. C-shaped guide plates are secured to the paper pressing rollers. Each of the C-shaped guide plates includes a roof member which is made contact with a pritrusion secured to a printer head when a shaft of the paper pressing rollers is held at a first stable position. When the printer head is driven to shift while the shaft is held at the first stable position, the paper pressing rollers are shifted on the shaft and controlled to be positioned at the desired left and right setting positions, respectively.

4 Claims, 7 Drawing Figures

PAPER SHEET SETTING MECHANISM IN A PRINTER

BACKGROUND OF THE INVENTION

1. Field of the Invention

The present invention relates to a printer and, more particularly, to a recording member pressing device in a printer which automatically selects a suitable pressing position of each of paper pressing rollers according to the size of a recording member inserted.

2. Description of the Prior Art

FIG. 1 shows a perspective view of a conventional paper pressing system for a recording paper feed device in a printer. A platen 40 is rotated around an axis 41 (as indicated by a chain line) connected with a rotating mechanism. Under the platen 40, a plurality of paper feed rollers 43 are rotatably provided around an axis 42 (as indicated by a chain line) parallel with the axis 41 of the platen 40 and are in contact with a part of the circumference surface of the platen 40. A plurality of paper pressing rollers 45 positioned above the platen 40 are rotatably provided around an axis 44 (as indicated by a chain line) parallel with the axis 41 of the platen 40 and are slidably moved along the axis 44. The paper pressing rollers 45 can be detached from the surface of the platen 40 by operating a manual lever. Usually, the paper pressing rollers 45 press a recording paper around the platen 40 because the axis 44 of the paper pressing rollers 45 is stressed by a spring.

When the recording paper is inserted from the rear side and the upper side of the platen 40 and the platen 40 is rotated, the recording paper is forwarded to the under portion of the platen 40 along the platen 40 and is passed between the platen 40 and the paper feed rollers 43, and after that, the recording paper is guided to the front side and the upper side of the platen 40 to apply the recording paper to a printing position of the printer.

When the recording paper is reached at the printing position, the paper pressing rollers 45 press the recording paper on the platen 40. In this case, the pressing position in the horizontal direction of each of the paper pressing rollers 45 is manually selected so that the paper pressing rollers 45 do not badly influence a printing operating of the printer.

In the printer having the above recording paper pressing system for a paper feed device, in the case where different size recording papers are used in it for printing, the pressing position of each of the paper pressing rollers 45 must be manually changed by the operator every time the size of the recording paper is changed. The pressing positions of the paper pressing rollers 45 must be set on the right and the left sides of the recording paper outside a printing area of the recording paper. The manual operation may cause the missetting of or the nonselection of the pressing position of each of the pressing rollers when the different size recording papers are applied to the printer.

In particular, in an ink jet type printer in which ink droplets are jetted from a nozzle of a printing head on the printing position of the recording paper, if any paper pressing roller is set out of the recording paper, the size of the printed characters may be varied according to the recording paper condition. On the other hand, when some of the paper pressing rollers press the printing area of the recording paper, the rollers may deteriorate the print quality by the wet ink.

Recently, an automatic paper supply device has been used in the printer. However, if the different size recording paper sheets are applied by the automatic paper supply device, the capability of the automatic paper supply device is remarkably decreased because the pressing positions of the paper pressing rollers of the paper pressing device must be manually selected by the operator.

OBJECTS AND SUMMARY OF THE INVENTION

OBJECTS OF THE INVENTION

Accordingly, it is an object of the present invention to provide a recording member pressing device for a printer which automatically selects a suitable position of each of sheet pressing rollers according to the size of the recording member and which enable a suitable printing operation with a high quality printing.

It is another object of the present invention to provide a paper pressing system for a paper feed device in a printer which accurately sets a recording paper to a printing position depending on the size of each of the recording papers.

It is still another object of the present invention to provide a paper pressing device for a printer which sets a recording paper to a printing position by automatically and slidably moving paper pressing rollers depending on the size of each of the recording paper sheets.

It is a further object of the present invention to provide a recording paper pressing device for a printer which automatically positions a recording paper sheet to a printing position by cooperating with an automatic paper supplying device even when the different size recording paper sheets are applied to the printer.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

SUMMARY OF THE INVENTION

To achieve the above objects, pursuant to an embodiment of the present invention, at least one of paper pressing rollers is automatically shifted along a shaft so that the paper pressing rollers accurately press the record receiving paper sheet near the both edges thereof. More specifically, an embodiment of the present invention includes a paper size detection sensor which detects the size of a record receiving paper sheet. A memory device is included in a printer, which memorizes preferred roller pressing positions for the respective paper sheet size. When the record receiving paper is inserted into the printer, at least one of the paper pressing rollers is automatically shifted in accordance with the preferred position data stored in the memory device.

BRIEF DESCRIPTION OF THE DRAWINGS

The present invention will be better understood from the detailed description given hereinbelow and the accompanying drawings which are given by way of illustration only, and thus are not limitative of the present invention and wherein.

DESCRIPTION OF THE PREFERRED EMBODIMENTS

Figure 1:
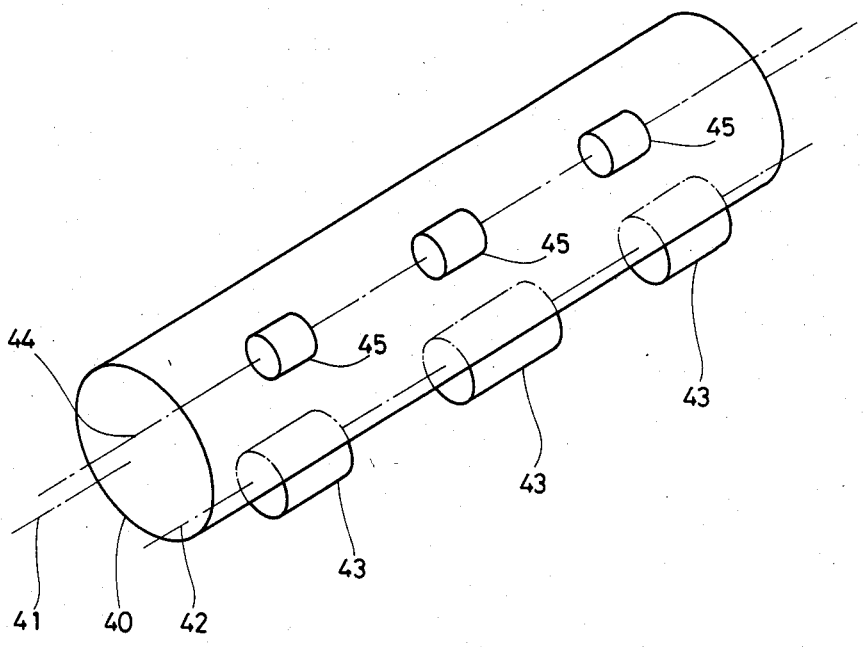
FIG.1 PRIOR ART
FIG. 1 is a perspective view of an essential part of the conventional recording member pressing device.
Figure 2:
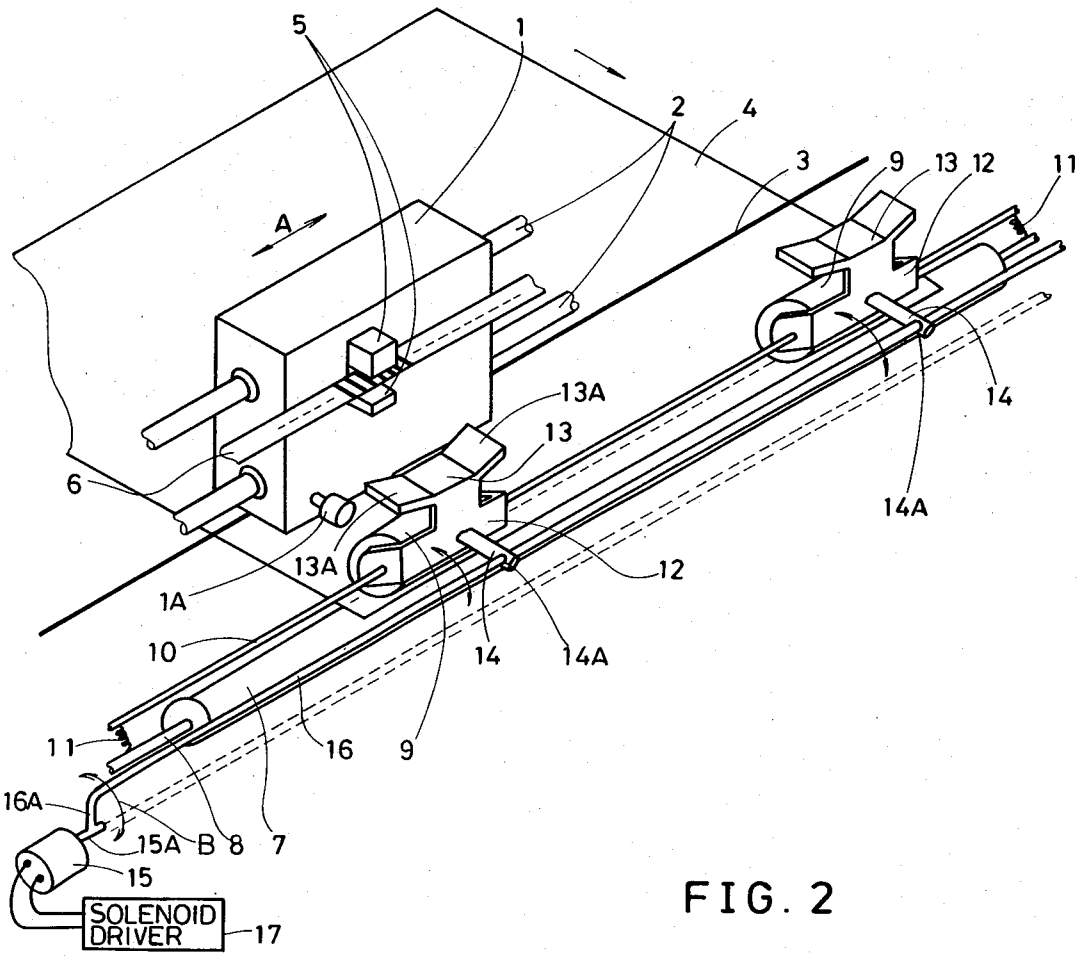
FIG. 2 is a perspective view of an essential part of an embodiment of a paper sheet setting mechanism of the present invention.

FIG. 2 shows a printer head of an ink jet system printer, which employs an embodiment of a paper sheet setting mechanism of the present invention.

A printer head 1 carries an ink jet nozzle, and is slidably mounted on a pair of shafts 2. The printer head 1 is connected to a motor (not shown) via a wire 3 so that the printer head 1 is driven to travel in the direction shown by an arrow A. A record receiving paper 4 is inserted from the upper side seen in FIG. 2 toward the printing position which is located under the printer head 1. Therefore, the ink jet nozzle is secured on the bottom surface of the printer head 1 as seen in FIG. 2 so that the ink jet nozzle confronts the record receiving paper 4. A pair of sensors (photo-coupler) 5 is provided on the printer head 1, which detects the position of the printer head 1 in unison with a slit tape 6 disposed along the travelling direction of the printer head 1.

A paper feed roller 7 is mounted on a shaft 8 which is parallel with the pair of shafts 2. The paper feed roller has an effective length which is longer than the maximum width of the record receiving paper sheet 4 intended to be used in the ink jet system printer. The shaft 8 is connected to a drive system so as to feed the record receiving paper sheet 4. Another shaft 10 is disposed along the paper feed roller 7. A pair of paper pressing rollers 9 are slidably, and rotatably mounted on the shaft 10. The shaft 10 is normally depressed toward the paper feed roller 7 by means of a pair of springs 11 so that the paper pressing rollers 9 contact the paper feed roller 7 in the normal operational mode. When the shaft 10 is pulled upward against the springs 11, the paper pressing rollers 9 are separated from the paper feed roller 7. When the record receiving paper 4 is inserted into the printing section, the leading edge of the record receiving paper 4 is caught by the paper feed roller 7 and the pair of paper pressing rollers 9. Another pair of paper feed rollers should be provided near the inlet of the record receiving paper sheet 4. A platen is preferably disposed under the record receiving paper sheet 4 so as to confront the printer head 1.

A C-shaped guide plate 12 is provided so as to support the paper pressing roller 9 at the both ends thereof. The C-shaped guide plate 12 is integral with a roof member 13 which is disposed over the paper pressing roller 9, and which has upwardly inclined ends 13A. A protrusion 1A is secured to the printer head 1 to confront the roof member 13. A rubber cushion is mounted on the tip end of the protrusion 1A so that the rubber cushion elevates the roof member 13 when the C-shaped guide plate 12 is located at a specific position.

Figure 3:
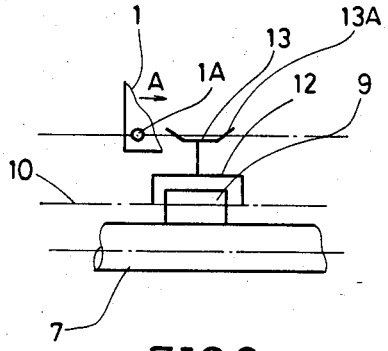
FIG. 3 is a schematic front view of a paper pressing roller shift mechanism included in the paper sheet setting mechanism of FIG. 2, showing an operational mode thereof.
Figure 4:
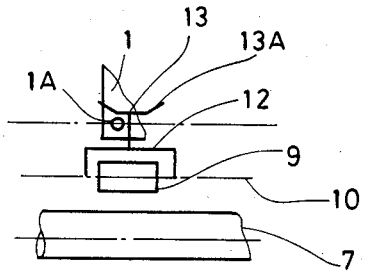
FIG. 4 is a schematic front view of the paper pressing roller shift mechanism, showing another operational mode.

FIGS. 3 and 4 show relationships between the protrusion 1A, the paper pressing roller 9, and the C-shaped guide plate 12. When the printer head 1 is moved in the direction shown by an arrow A in FIG. 3, the protrusion 1A contacts one of the upwardly inclined ends 13A of the roof member 13. If the printer head 1 is driven to further travel in the direction shown by the arrow A in FIG. 3, the protrusion 1A pushes the upwardly inclined end 13A upwardly, and the protrusion 1A goes under the roof member 13 as shown in FIG. 4. The shaft 10 of the paper pressing rollers 9 is pulled upward via the C-shaped guide plate 12 against the depression force created by the springs 11. That is, the paper pressing rollers 9 are separated from the paper feed roller 7, and the paper pressing roller 9 is moved on the shaft 10 in the direction shown by the arrow A in FIG. 3 in unison with the shift movement of the printer head 1 on the pair of shafts 2.

A coupling rod 14 is secured to the C-shaped guide plate 12. The tip end of the coupling rod is slidably secured to a drive shaft 16 which is driven by a rotary solenoid 15. The drive shaft 16 is parallel with the shaft 10, and is disposed through a coupling hole 14A formed in the coupling rod 14. One end of the drive shaft 16 is integral with an angled portion 16A, and the angled portion 16A is connected to a rotating shaft 15A of the rotary solenoid 15.

The rotary solenoid 15 is controlled by a solenoid driver 17. The rotary solenoid 15 functions to rotate the drive shaft 16 in the direction shown by an arrow B in FIG. 2. The drive shaft 16 is stably held at one of two stable positions. The solid line of FIG. 2 shows the first stable position, wherein the protrusion 1A secured to the printer head 1 can contact the roof members 13 of the guide plates 12. The broken line in FIG. 2 shows the second stable position, wherein the drive shaft 16 is rotated so that the guide plates 12 are rotated around the shaft 10 via the coupling rods 14, whereby the protrusion 1A secured to the printer head 1 does not contact the roof members 13. The above-mentioned shift operation of the paper pressing rollers 9 along the shaft 10 is conducted when the drive shaft 16 is held at the first stable position. In this case, the coupling rod 14 slides on the drive shaft 16 when the roof member 13 is pushed by the protrusion 1A in the direction shown by the arrow A in FIG. 2. The ink jet system printer includes a paper sheet size detection unit which detects the size of the record receiving paper sheet 4. The paper sheet size detection unit can be the conventional construction.

Figure 5:
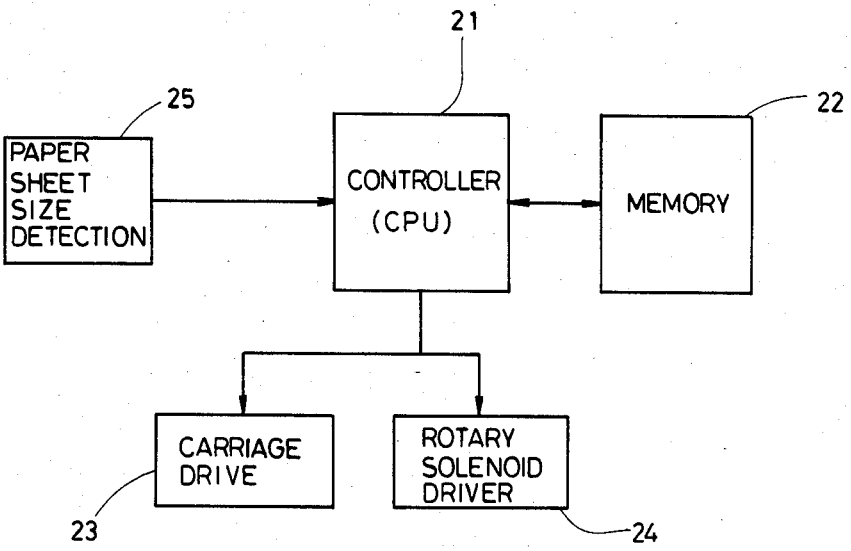
FIG. 5 is a block diagram of a control circuit for automatically selecting the pressing position of each of the paper pressing rollers included in the paper sheet setting mechanism of FIG. 2.

FIG. 5 shows a block diagram of a control circuit for automatically selecting the pressing position of each of the paper pressing rollers 9 depending on the size of the inputted record receiving paper sheet 4. The control circuit of FIG. 5 comprises a controller 21 such as a one-chip CPU (central processing unit) including an input/output interface and a memory for controlling a program, a memory 22 for storing positioning information relating to both right positions and left positions of the paper pressing rollers 9 corresponding to the various different size of the record receiving paper sheet 4, a driver 23 controlled by the CPU 21 for driving the printer head, a solenoid driver 24 (17 in FIG. 2) for driving the rotary solenoid 15, and a paper size detecting means 25 for detecting the size of the inserted record receiving paper sheet 4.

Figure 6:
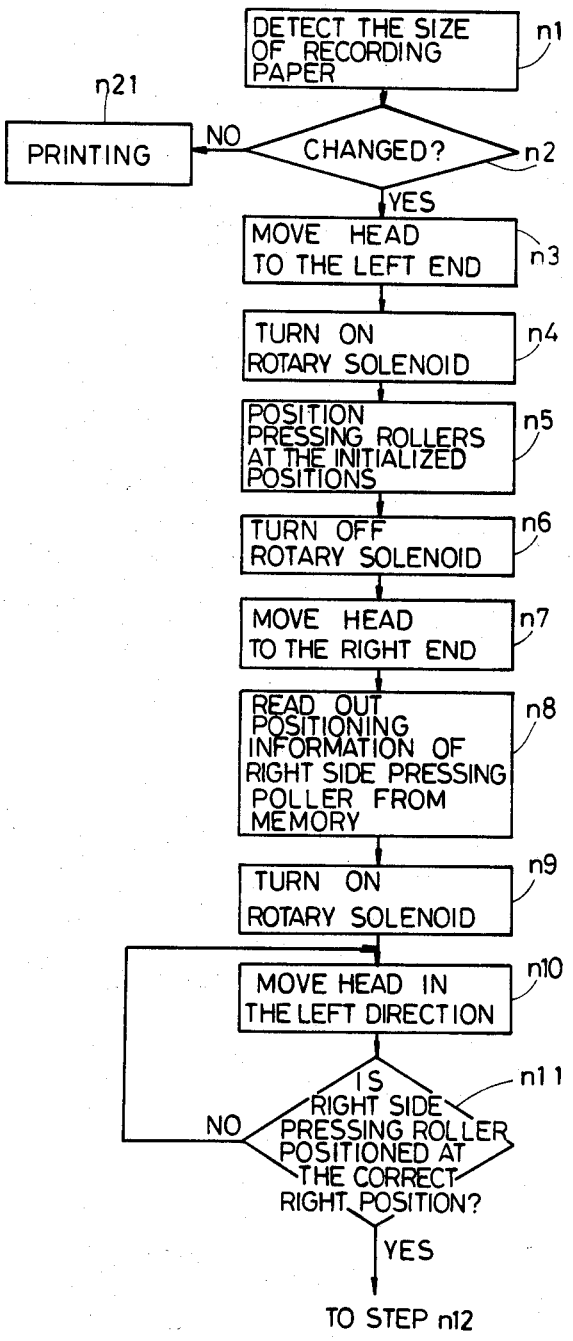
FIGS. 6(A) and 6(B) are flow charts for explaining an operational mode of the paper sheet setting mechanism of FIG. 2.
Figure 6:
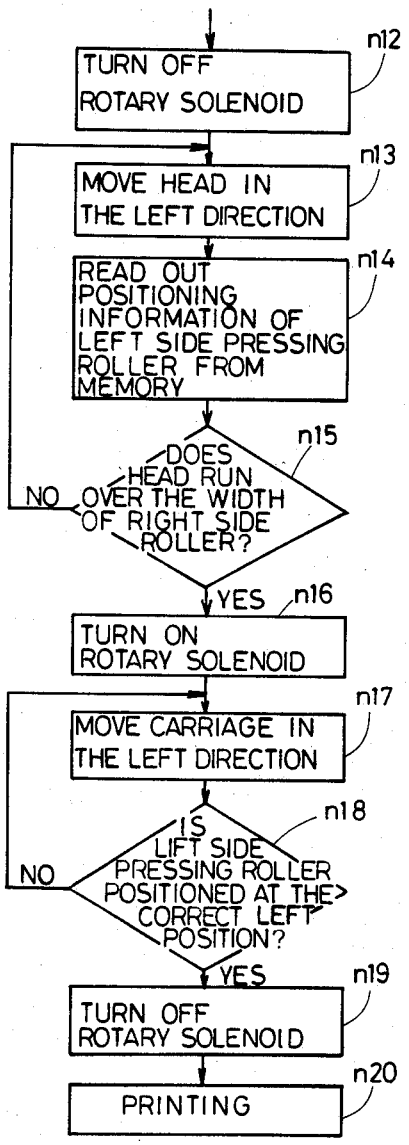

The operation of the paper sheet setting mechanism of FIGS. 2 and 5 will be described below with reference to flow charts of FIGS. 6(A) and 6(B).

When the record receiving paper sheet 4 is inserted into the ink jet system printer, the size of the inputted record receiving paper sheet 4 is detected by the paper size detecting means 25 arranged around the paper inserting portion. The detecting signal from the paper size detecting means 25 is applied to the CPU 21. The CPU 21 is operated to judge the size of the inputted record receiving paper sheet in response to the applied detecting signal (Step n1). After detecting the paper size, the size of the presently inputted record receiving paper sheet is compared with the size of the last inputted record receiving paper sheet to determine whether the paper size is changed (Step n2). If the size of the presently inputted paper and that of the last inputted paper are the same, the program is forwarded to Step n21 for executing a normal printing operation. On the other hand, when the size of the presently inputted record receiving paper sheet 4 is different from the size of the last inputted record receiving paper sheet, the printer head 1 is first shifted to the left end of the shaft 3 (Step n3). When the printer head 1 reaches the left end, the rotary solenoid 15 is enabled by the driver 17 (24) (Step n4).

When the rotary solenoid 15 is enabled, the drive shaft 16 is stably held at the first stable position shown by the solid line in FIG. 2. That is, the protrusion 1A secured to the printer head 1 is engageable with the roof members 13. Thereafter, the printer head 1 is shifted rightward so that the paper pressing rollers 9 are shifted to the roller initialize position, which is located near the rightmost end of the shaft 10 (step n5).

More specifically, the printer head 1 is driven to shift on the shafts 2 rightward under the condition where the drive shaft 16 is held at the first stable position. The protrusion 1A secured to the printer head 1 contacts the roof members 13 associated with the left one of the paper pressing rollers 9. The protrusion 1A functions to lift up the shaft 10 against the springs 11.

The paper pressing rollers 9 are separated from the paper feed roller 7. The paper pressing roller 9 and the C-shaped guide plate 12 are shifted rightward on the shaft 10 as the printer head 1 is driven to shift on the shafts 2 rightward. Then, the right one of the paper pressing rollers 9 is pushed rightward by the left one of the paper pressing rollers 9 via the C-shaped guide plates 12. In this way, both of the paper pressing rollers 9 are held at the roller initialize position. The roller initialize position is set at the point slightly separated from the rightmost end of the travelling distance of the printer head 1.

When the paper pressing rollers 9 are placed at the roller initialize position, the rotary solenoid 15 is turned off (step n6). When the rotary solenoid 15 is turned off, the drive shaft 15 is rotated, and stably held at the second stable position as shown by the broken line in FIG. 2. When the drive shaft 16 is rotated, the C-shaped guide plates 12 associated with the paper pressing rollers 9 are rotated around the shaft 10 via the coupling rods 14. Thus, the roof members 13 of the C-shaped guide plates 12 do not contact the protrusion 1A secured to the printer head 1. The printer head 1 is further driven to travel rightward along the shafts 2 without shifting the paper pressing rollers 9, and the printer head 1 is stopped at a predetermined position beyond the paper pressing rollers 9 (step n7).

In this way, the initializing opeation is completed. Then, the right one of the paper pressing rollers 9 is first set at a desired position. A desired right roller setting position related to the detected paper size is read out from the memory 22 (step n8). Then, the rotary solenoid 15 is again turned on (step n9). The drive shaft 16 is rotated, and is held at the first stable position shown by the solid line in FIG. 2. The C-shaped guide plates 12 associated with the paper pressing rollers 9 are rotated around the shaft 10 so that the roof members 13 are placed at the positions where the protrusion 1A secured to the printer head 1 can contact the roof members 13 of the C-shaped guide plates 12.

Thereafter, the printer head 1 is driven to travel leftward from the rightmost position (step n10). The protrusion 1A secured to the printer head 1 contacts the roof member 13 of the right one of the paper pressing rollers 9. The shaft 10 is pulled upward so that the paper pressing rollers 9 are separated from the paper feed roller 7. Under these conditions, both the paper pressing rollers 9 are shift leftward as the printer head 1 is driven to travel leftward. The leftward movement is conducted till the right one of the paper pressing rollers 9 is located at the desired right roller setting position which has been read out from the memory 22 (step n11).

When the right one of the paper pressing rollers 9 reaches the desired setting position, the rotary solenoid 15 is turned off (step n12). The drive shaft 16 is rotated, and is held at the second stable position shown by the broken line in FIG. 2, where the protrusion 1A secured to the printer head 1 does not contact the roof members 13 associated with the paper pressing rollers 9. The printer head 1 is further shifted leftward (step n13), during which the desired left roller setting position data is read out from the memory 22 (step n14). Then, a determination is carried out whether the printer head 1 has travelled over the right one of the paper pressing rollers 9 (step n15). The determination is carried out by comparing the memorized width information of the right one of the paper pressing rollers with the travelling distance of the printer head 1 after the drive shaft 16 is held at the second stable position. When the printer head 1 has travelled over the right one of the paper pressing rollers 9, the rotary solenoid 15 is again turned on (step n16) in order to set the left one of the paper pressing rollers 9. The drive shaft 16 is rotated, and is held at the first stable position shown by the solid line in FIG. 2. The left one of the paper pressing rollers 9 is shifted leftward as the printer head 1 is driven to travel leftward (step n17). The roller shifting operation is conducted till the left one of the paper pressing rollers 9 reaches the desired left roller setting position which has been read out from the memory 22 (step n18). When the left one of the paper pressing rollers 9 reaches the desired left roller setting position, the rotary solenoid 15 is turned off (step n19), and then, an actual printing operation is carried out (step n20). During the actual printing operation, the rotary solenoid 15 is turned off, and the drive shaft 16 is held at the second stable position shown by the broken line in FIG. 2, where the paper pressing rollers 9 are free from the movement of the printer head 1.

In this way, both the paper pressing rollers 9 are set at the desired setting positions, respectively, and the both paper pressing rollers 9 function, in combination with the paper feed roller 7, to support the record receiving paper 4 while the drive shaft 16 is placed at the second stable position shown by the broken line in FIG. 2. The roller setting operation is conducted each time when the size of the record receiving paper sheet 4 changes. The paper pressing roller position setting operation is not necessarily conducted from the right one of the paper pressing rollers 9. That is, the initialize position can be selected near the leftmost position of the travelling distance of the printer head, or at the center of the travelling distance of the printer head 1. The paper sheet setting mechanism of the present invention is very effective when combined with an automatic paper sheet supply mechanism in a printer such as an ink jet system printer.

The invention being thus described, it will be obvious that the same may be varied in many ways without departure from the spirit and scope of the invention, which is limited only by the following claims.

What is claimed is:

1. A paper sheet setting mechanism in a printer comprising:

a printer head slidably secured on a first shaft;

first drive means for shifting said printer head on said first shaft;

a paper feed roller disposed along said first shaft;

at least two paper pressing rollers slidably, and rotatably mounted on a second shaft which is parallel with said first shaft;

engaging means for separating each of said at least two paper pressing rollers from said paper feed roller, said engaging means secured to each of said at least two paper pressing rollers;

second drive means for rotating a third shaft around said second shaft, said third shaft is parallel with said first and second shafts;

said second drive means including stably holding means for stably holding said third shaft at a first stable position or at a second stable position around said second shaft; and a protrusion secured to and movable together with said printer head, which contacts said engaging means when said third shaft is held at said first stable position to separate said each of said paper pressing rollers from said paper feeding roller and to slide each of said paper pressing rollers along said second shaft.

2. The paper sheet setting mechanism of claim 1, further comprising:

paper size detection means for detecting a size of a record receiving paper sheet inserted into a printer;

a memory storing a desired right setting position of the right one of said at least two paper pressing rollers and a desired left setting position of the left one of said at least two paper pressing rollers for the various size of the record receiving paper sheet;

read out means for reading out said desired right setting position and said desired left setting position stored in said memory in accordance with the paper sheet size detected by said paper size detection means; and control means which controls said first and second drive means so as to position said at least two paper pressing rollers at said desired right setting position and said desired left setting position, respectively.

3. The paper sheet setting mechanism of claim 2, further comprising spring means for depressing said second shaft toward said paper feed roller so that said at least two paper pressing rollers normally contact said paper feed roller.

4. The paper sheet setting mechanism of claim 3, each of said engaging means comprising:

a C-shaped guide plate disposed about said paper pressing roller so as to support said paper pressing roller at the both ends thereof; and a roof member integral with said C-shaped guide plate, said roof member being disposed above said paper pressing roller, and having inclined portions at both edges thereof, wherein said protrusion contacts said inclined portion of said roof member when said third shaft is held at said first stable position, and is slided under said roof member as said printer head is driven to travel on said first shaft, said protrusion functioning to lift up said engaging means against the depressing force of said spring means, thereby shifting said paper pressing roller on said second shaft as said printer head is driven to shift on said first shaft.

* * * * *